US006702195B2

(12) United States Patent
Trabold

(10) Patent No.: US 6,702,195 B2
(45) Date of Patent: Mar. 9, 2004

(54) MULTI-LAYER SLOT COATING DIE WITH SELECTIVE ULTRASONIC ASSIST

(75) Inventor: Thomas A. Trabold, Pittsford, NY (US)

(73) Assignee: Xerox Corporation, Stamford, CT (US)

( * ) Notice: Subject to any disclaimer, the term of this patent is extended or adjusted under 35 U.S.C. 154(b) by 27 days.

(21) Appl. No.: 10/195,873

(22) Filed: Jul. 15, 2002

(65) Prior Publication Data

US 2004/0007630 A1 Jan. 15, 2004

(51) Int. Cl.[7] ..... B05B 1/08
(52) U.S. Cl. ..... 239/102.1; 239/406; 239/417.5
(58) Field of Search ..... 239/102.1, 102.2, 239/398, 406, 416.4, 416.5, 417.5, 418

(56) References Cited

U.S. PATENT DOCUMENTS

| | | | | |
|---|---|---|---|---|
| 4,096,013 | A | * 6/1978 | Lutzmann et al. | 156/272.6 |
| 5,262,193 | A | 11/1993 | Louks et al. | |
| 5,336,534 | A | 8/1994 | Nakajima et al. | |
| 5,376,402 | A | 12/1994 | Louks et al. | |
| 5,454,929 | A | * 10/1995 | Kinghorn | 205/128 |
| 5,470,656 | A | * 11/1995 | Kennard et al. | 428/370 |
| 5,549,961 | A | * 8/1996 | Haas et al. | 428/143 |
| 5,626,947 | A | * 5/1997 | Hauer et al. | 428/195.1 |
| 5,858,475 | A | 1/1999 | Chiu | |
| 6,048,658 | A | * 4/2000 | Evans et al. | 430/132 |
| 6,547,920 | B2 | * 4/2003 | Gatica et al. | 156/345.2 |
| 6,600,866 | B2 | * 7/2003 | Gatica et al. | 385/135 |
| 2001/0016249 | A1 | * 8/2001 | Kitamura et al. | 428/195 |
| 2002/0022203 | A1 | * 2/2002 | Habu et al. | 430/620 |
| 2002/0090463 | A1 | * 7/2002 | Louks et al. | 427/420 |
| 2003/0073046 | A1 | * 4/2003 | Iwado | 430/523 |

FOREIGN PATENT DOCUMENTS

EP 000002167 A1 * 5/1979

* cited by examiner

*Primary Examiner*—William E. Tapolcai
*Assistant Examiner*—Mohammad M. Ali
(74) *Attorney, Agent, or Firm*—Fay, Sharpe, Fagan, Minnich & Mckee, LLP

(57) ABSTRACT

A multi-layer slot coating die (A) includes a housing (30) having a cavity therein, and a divider (32) arranged within the cavity of the housing (30) such that a plurality of separate channels are defined therein. The channels have elongated openings on an output side of the die (A) from which layers (10, 12) of coating material are extruded, and an ultrasonic transducer (44) is mechanically coupled to the divider (32).

23 Claims, 2 Drawing Sheets

MULTI-LAYER SLOT COATING DIE WITH SELECTIVE ULTRASONIC ASSIST

FIELD OF THE INVENTION

The present invention relates to the printing and/or copying arts. It finds particular application in conjunction with the production of photoreceptor belts for electrophotographic copiers, and will be described with particular reference thereto. However, it is to be appreciated that the present invention is also amenable to other like applications where it is desired to apply a plurality of coatings with even thicknesses to a web material.

BACKGROUND OF THE INVENTION

In the case of electrophotographic devices such as, e.g., copiers, it is known to employ a photoreceptive belt to form latent electrostatic images within the device. Belt type photoreceptors typically include a photoreceptive material applied to a polymer or other like continuous web which is moved about an arrangement of rollers. Belt type photoreceptors generally have larger photoreceptive surfaces as compared to drum type photoreceptors, and accordingly, can hold more latent images per cycle. Hence, belt type photoreceptors are often employed in higher-end electrophotographic devices or like applications where high speed is desired.

The photoreceptive material applied to the web may include as many as four separate layers. The four layers include: a first layer (nearest to the web) known as the undercoat layer; a second layer known as the charge generation or binder generator layer, i.e., where the charge is actually generated by converting photons into electrostatic charge; a third layer known as the small molecule transport layer; and a optional fourth or top layer (farthest from the web) known as the overcoat layer. Coating techniques suitable for applying the layers are known in the art. However, many of the previously developed techniques suffer insomuch as they only apply a single layer at a time. This is disadvantageous to the extent that the manufacturing of the photoreceptive belt then involves as many coating operations as there are layers. When coating one layer at a time, photoreceptor belt production can be undesirably time consuming.

Generally, uneven thickness in the layers of the photoreceptive material results in performance degradation of the belt. Accordingly, it is desired that each layer have a substantially uniform thickness across the web. For example, manufacturing specifications for the small molecule transport layer, which is typically the thickest layer, may have a tolerance of plus or minus one-half of a micron over a web that is a thousand feet long by forty inches wide. Unassisted coating techniques suffer to the extent that they cannot provide the uniformity of thickness desired. Many unassisted techniques have a limited coating thickness uniformity, e.g., in the neighborhood of plus or minus two percent. Consequently, ultrasonic assisted coating techniques have been developed which aid in achieving a uniform thickness for a coating layer. However, to date, the developed ultrasonic assisted coating techniques have been limited to applying a single layer at a time with the ultrasonic energy being introduced through the entire die or from behind the web. For multi-layer applications, such an introduction of the ultrasonic energy can have undesired effects. For example, the locationally generalized application of ultrasonic energy through the entire die may cause the layers to become undesirably intermixed, or insomuch as the ultrasonic energy is introduce from the back side of the web and has to travel through the layers, the effects may be significantly different in the various layers due to the relatively different acoustic impedances thereof.

The present invention contemplates a new and improved multi-layer slot coating die with ultrasonic assist and/or associated method which overcomes the above-referenced problems and others.

SUMMARY OF THE INVENTION

In accordance with an aspect of the present invention, a multi-layer slot coating die is provided. The die includes a housing having a cavity therein, and a divider arranged within the cavity of the housing such that a plurality of separate channels are defined therein. The channels have elongated openings on an output side of the die from which layers of coating material are extruded, and an ultrasonic transducer is mechanically coupled to the divider.

In accordance with another aspect of the present invention, a method is provided for coating a web with a plurality of layers of coating material. The method includes: advancing the web in a first direction; in a second direction transverse to the first direction, extruding the plurality of layers of coating material onto the advancing web such that there is a contact interface between two of the layers; and, applying ultrasonic energy to the contact interface.

In accordance with yet another aspect of the present invention, a multi-layer slot coating die includes a housing having a cavity therein. The housing includes first and second portions. The first portion contacts an upstream meniscus which is formed as layers of coating material are extruded from an output side of the die onto an advancing web, and the second portion contacts a downstream meniscus which is formed as layers of coating material are extruded from the output side of the die onto the advancing web. The die also includes a divider arranged within the cavity of the housing such that a plurality of separate channels are defined therein. The channels have, on the output side of the die, elongated openings from which layers of coating material are extruded, and an ultrasonic transducer mechanically coupled to at least one of the divider, the first portion of the housing and/or the second portion of the housing.

One advantage of the present invention is that it provides for multi-layer coating.

Another advantage of the present invention is that it provides for even layer thickness via ultrasonic assistance.

Still further advantages and benefits of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention. Further, it is to be appreciated that the drawings are not to scale.

DETAILED DESCRIPTION OF THE INVENTION

Figure 1:
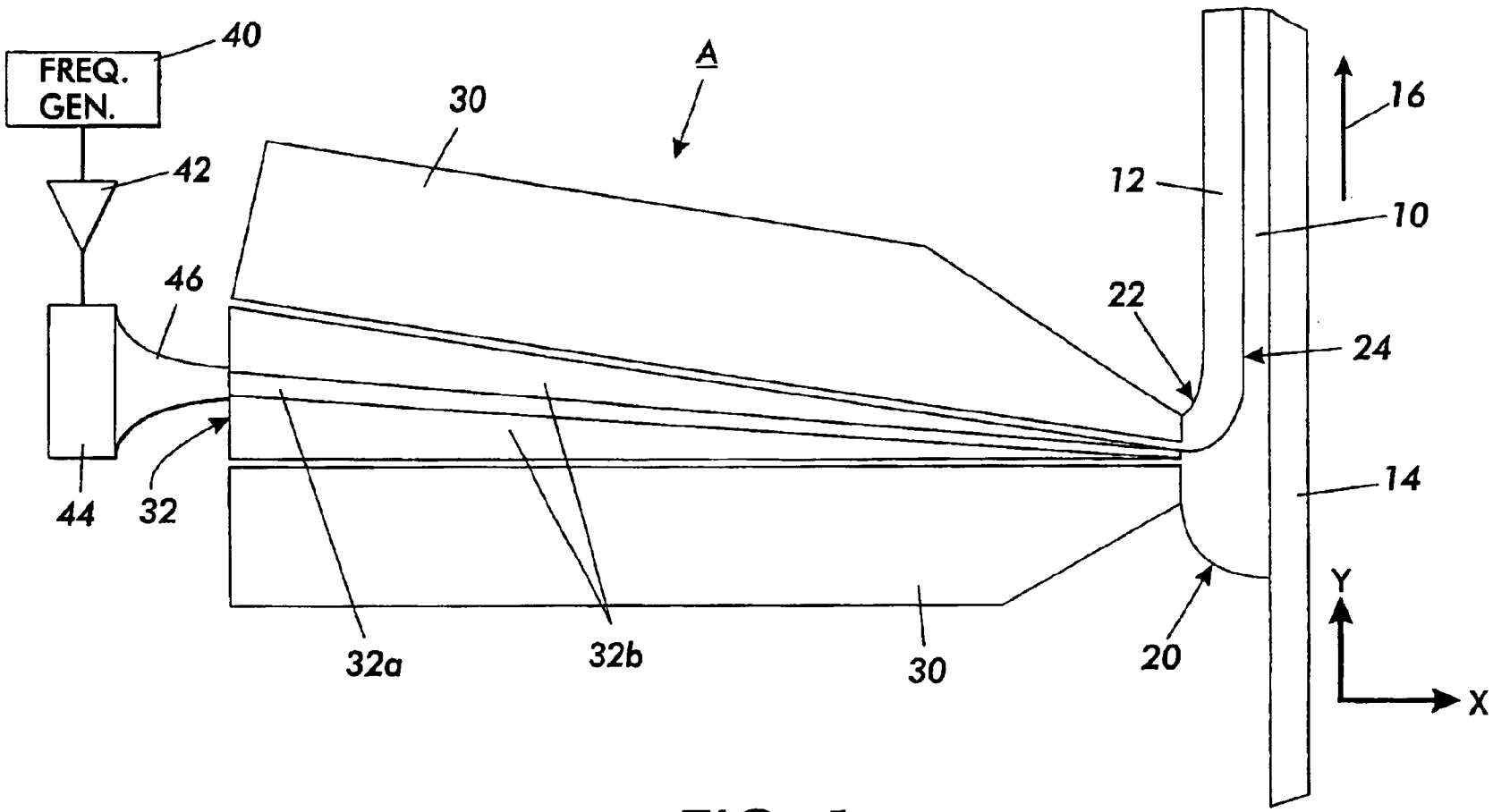
FIG. 1 is a diagrammatic illustration showing in cross-section an exemplary multi-layer slot coating die with ultrasonic assist in accordance with aspects of the present invention.

With reference to FIG. 1, a multi-layer slot coating die A with ultrasonic assist is shown applying two layers 10 and 12 of, e.g., fluid photoreceptor material or other like fluid material, to a web 14 being advanced in the direction of arrow 16 in front of the output side of the die A. As the layers 10 and 12 are being extruded or otherwise output from the die A to coat the advancing web 14, an upstream meniscus 20 is formed, a downstream meniscus 22 is formed, and a fluid-to-fluid contact line 24 results between the layers 10 and 12.

The die A preferably includes an outer housing 30 and an internal divider 32. Together the housing 30 and divider 32 define a pair of separate cavities or channels, i.e., one for dispensing each of the layers 10 and 12. The fluid materials which form the layers 10 and 12 are simultaneously pumped or pushed (from left to right as shown in FIG. 1) through the separate cavities or channels of the die A which are defined by and formed between the housing 30 and the divider 32. The die's housing 30 and divider 32 are shaped and/or arranged to provide narrow (e.g., on the order of five thousandths of an inch) elongated openings for each of the cavities or channels on the output side of the die A, i.e., the right side as shown in FIG. 1. Preferably, the elongated dimension of the openings extend along substantially the entire width of the web 14. Accordingly, as the layers 10 and 12 are extruded from the openings, they will form thin coatings that span substantially the entire width of the web 14. Alternately, the elongated openings may be some fraction of the width of the web 14. However, multiple pass would then be involved if the entire width of the web 14 were to be coated with the layers 10 and 12. Note that, in any event, the width dimension as shown in FIG. 1 is taken as the dimension normal to the x-y plane, and the narrow opening dimension as shown in FIG. 1 is taken in the y direction. Optionally, the housing 30 is made out of stainless steel or some similar metal or other suitable material.

Preferably, a frequency generator 40 or other like electrical oscillator generates a signal which is optionally amplified by amplifier 42. The signal is applied to and/or drives an ultrasonic transducer 44 which is mechanically coupled to the divider 32. The driven ultrasonic transducer 44 generates ultrasonic energy which is introduced through the mechanical coupling 46 into the divider 32 on a backside of the die A, i.e., opposite the output side of the die A.

The divider 32 preferably includes an inner core 32*a* to which the ultrasonic transducer 44 is mechanically coupled, and an outer covering 32*b* in between which the core 32*a* is sandwiched. As shown, the divider 32 as a whole is tapered to form a wedge shape having a relatively thick backside, and a thin output side lip which is arranged between and separates the narrow elongated openings of the cavities or channels. Preferably, the core 32*a* itself also similarly tapers from a thicker backside to a thinner output side. Likewise, preferably, each portion (i.e., the top and bottom as shown in FIG. 1) of the covering 32*b* similarly tapers from a thicker backside to a thinner output side. The core 32*a* is preferably made from a material having an acoustic speed which is faster than that of the material from which the covering 32*b* is made, and the core material and covering material also preferably have mismatched acoustic impedances. In a preferred embodiment, the core 32*a* is stainless steel which has an approximate acoustic speed of 5.5 km/sec and an acoustic impedance of about 4.5 g/(cm$^2$ sec), and the covering 32*b* is Teflon® (i.e., polytetrafluoroethylene) which has an approximate acoustic speed of 1.4 km/sec and an acoustic impedance of about 0.3 g/(cm$^2$ sec). Of course, other similar alternative materials as are suitable may be substituted.

The tapered shapes and faster acoustic speed of the core 32*a* relative to the covering 32*b* guide and/or focus the ultrasonic energy introduced at the backside of the divider 32 to the thin lip at the output side thereof. Additionally, the acoustic impedance mismatch tends to cause the ultrasonic energy to be reflect at the core-covering interface so that it travels through and is maintained in the core 32*a* rather than being transmitted through the covering 32*b* to the rest of the die A.

Without the ultrasonic energy at the output side lip of the divider 32*b*, the fluid-to-fluid contact line 24 may move or drift back and forth across the face of the lip thereby creating a hydrodynamically unstable condition and potentially limiting the range of web speeds and/or fluid flow rates for which an adequate coating is obtainable. That is to say, the desired uniformity of thickness in the layers 10 and/or 12 may not be achieved, and/or acceptable operating conditions or parameters for the production of photoreceptor belts may be undesirably limited. However, guiding to and/or focusing sufficient ultrasonic energy at the lip of the divider 32*b* effectively pins the fluid-to-fluid contact line 24 to a substantially fixed position thereby stabilizing the same such that uniform thickness for the layers 10 and/or 12 is achievable.

Figure 2:
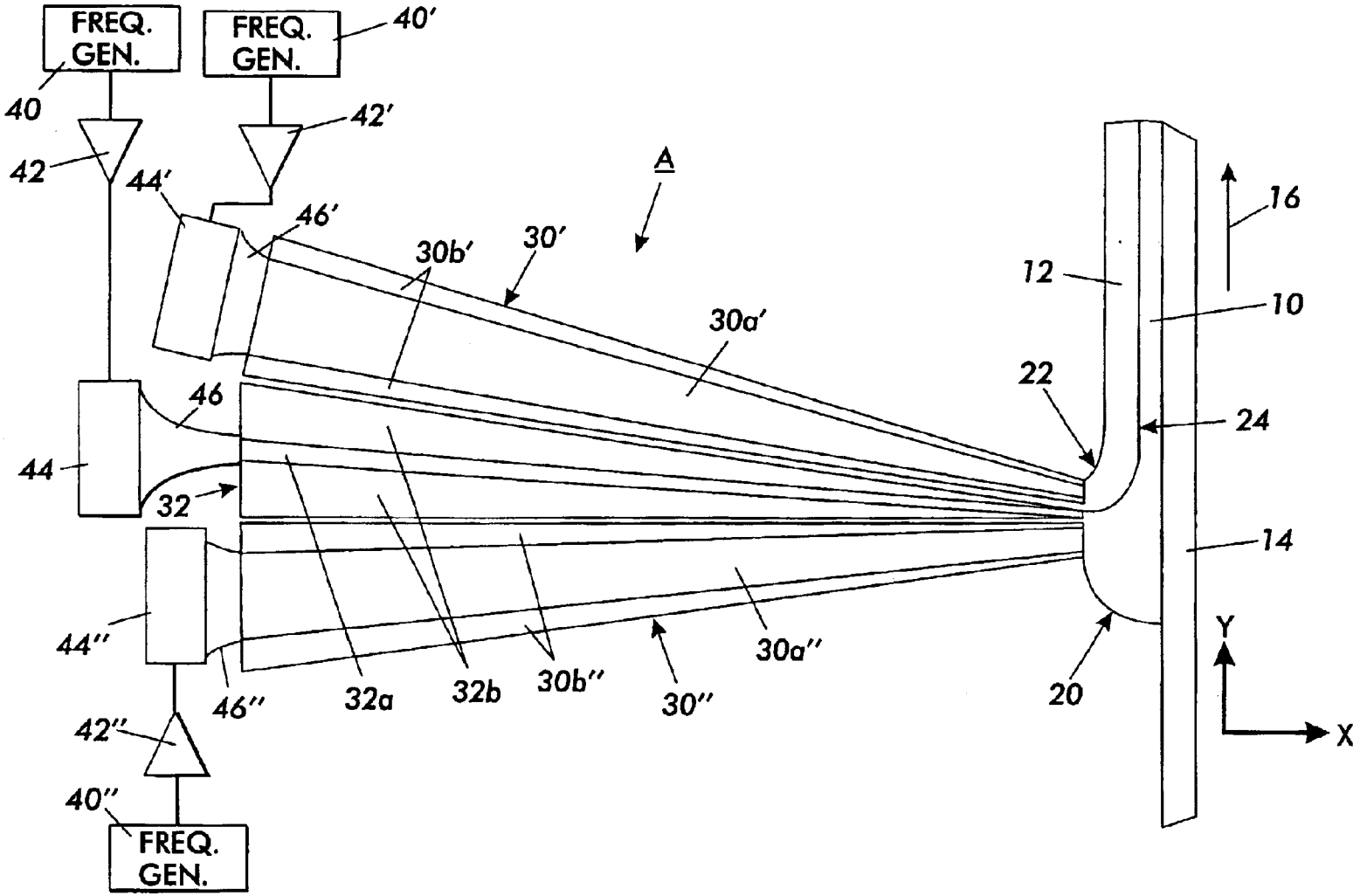
FIG. 2 is a diagrammatic illustration showing in cross-section an alternate embodiment of the exemplary multi-layer slot coating die of FIG. 1.

With reference to FIG. 2, the upper portion 30' and lower portion 30" corresponding to the housing 30 are constructed and operate or function like the divider 32. That is to say, the upper portion 30' includes a core 30*a*' and covering 30*b*' which correspond to and function like the core 32*a* and covering 32*b*, respectively. Similarly, the lower portion 30" includes a core 30*a*" and covering 30*b*" which also correspond to and function like the core 32*a* and covering 32*b*, respectively. Ultrasonic energy generated by ultrasonic transducers 44' and 44" is applied to the backsides of the upper and lower portions 30' and 30" of the housing via mechanical couplings 46' and 46" preferably connected to the cores 30*a*' and 30*a*", respectively. Optionally, as shown each transducer 44, 44' and 44" is driven by its own frequency generator 40, 40' and 40" and optional amplifier 42, 42' and 42". Alternately, a single frequency generator and/or single amplifier is used to drive all or a plurality of the transducers 44, 44' and 44". Note that, in the case of a single frequency generator or a single amplifier, optionally the device is a multi-channel device so that different signals may by be supplied to and/or drive the respective transducers 42, 42' and 42" as desired. In this alternate embodiment, ultrasonic energy is guided down the upper portion 30' of the housing and/or focused at the output side thereof such that the downstream meniscus 22 is stabilized in similar fashion to the fluid-to-fluid contact line 24. Likewise, ultrasonic energy is guided down the lower portion 30" of the housing and/or focused at the output side thereof such that the upstream meniscus 20 is also stabilized in similar fashion to the fluid-to-fluid contact line 24. Importantly, the particularities (e.g., frequency, amplitude, phase, etc.) of the ultrasonic energy applied to each of the upstream meniscus 20, the downstream meniscus 22 and the fluid-to-fluid contact line 24 can be individually tailored as desired to best stabilize the respective surface or interface.

While the slot coating die A shown in the illustrated examples of FIGS. 1 and 2 is only a two layer die, it is to be appreciated that more layers are contemplated. For example, by including another divider within the housing 30, a three layer slot coating die results. Additionally, if the additional divider is constructed and operated (i.e., has ultrasonic energy applied thereto) like the divider 32, then the fluid-to-fluid contact line resulting between the second layer and the additional third layer would be stabilized in similar fashion to the fluid-to-fluid contact line 24. In this manner, each additional divider provides for an additional layer such that the number of layers is equal to the number of dividers plus one. A four layer slot coating die is particularly advantageous for the production of photoreceptor belts.

The invention has been described with reference to the preferred embodiments. Obviously, modifications and alterations will occur to others upon reading and understanding the preceding detailed description. It is intended that the invention be construed as including all such modifications and alterations insofar as they come within the scope of the appended claims or the equivalents thereof.

What is claimed is:

1. A multi-layer slot coating die comprising:

a housing having a cavity therein;

a divider arranged within the cavity of the housing such that a plurality of separate channels are defined therein, the channels having elongated openings on an output side of the die from which layers of coating material are extruded; and, an ultrasonic transducer mechanically coupled to the divider.

2. The multi-layer slot coating die of claim 1, wherein the divider is tapered such that it has a first end which is thicker than a second end opposite the first end, said second end forming a lip between two of the openings on the output side of the die.

3. The multi-layer slot coating die of claim 2, wherein the ultrasonic transducer is mechanically coupled to the first end of the divider.

4. The multi-layer slot coating die of claim 1, wherein the divider comprises:

a core made from a first material having a first acoustic speed; and, an outer covering in between which the core is sandwiched, said outer covering being made from a second material having a second acoustic speed which is different from the first acoustic speed.

5. The multi-layer slot coating die of claim 4, wherein the first acoustic speed is greater than the second acoustic speed.

6. The multi-layer slot coating die of claim 1, wherein the divider comprises:

a core made from a first material having a first acoustic impedance; and, an outer covering in between which the core is sandwiched, said outer covering being made from a second material having a second acoustic impedance which is different from the first acoustic impedance.

7. The multi-layer slot coating die of claim 6, wherein the first acoustic impedance is greater than the second acoustic impedance.

8. The multi-layer slot coating die of claim 1, wherein the divider comprises:

a core made from stainless steel; and, an outer covering in between which the core is sandwiched, said outer covering being made from polytetrafluoroethylene.

9. The multi-layer slot coating die of claim 1, wherein the divider comprises:

a tapered core which has a first end that is thicker than a second end opposite the first end, said second end being on the output side of the die; and, an outer covering in between which the core is sandwiched.

10. The multi-layer slot coating die of claim 1, wherein the divider comprises:

a core; and, an outer covering in between which the core is sandwiched; said outer covering being tapered such that it has a first end that is thicker than a second end opposite the first end, said second end being on the output side of the die.

11. The multi-layer slot coating die of claim 1, wherein the divider comprises:

a core to which the ultrasonic transducer is mechanically coupled; and, an outer covering in between which the core is sandwiched.

12. The multi-layer slot coating die of claim 1, wherein ultrasonic energy generated by the ultrasonic transducer is applied to a first end of the divider and is guided through the divider to a second end of the divider opposite the first end, said second end being on the output side of the die.

13. The multi-layer slot coating die of claim 12, wherein the ultrasonic energy is focused at the second end of the divider.

14. The multi-layer slot coating die of claim 12, wherein the divider comprises:

means for internally reflecting the ultrasonic energy to limit it from being transmitted laterally out of the divider.

15. The multi-layer slot coating die of claim 1, further comprising:

a frequency generator that produces a signal which is used to drive the ultrasonic transducer; and, an amplifier that amplifies the signal.

16. A method for coating a web with a plurality of layers of coating material, said method comprising:

(a) advancing the web in a first direction;

(b) in a second direction transverse to the first direction, extruding the plurality of layers of coating material onto the advancing web such that there is a contact interface between two of the layers; and, (c) applying ultrasonic energy to the contact interface.

17. The method of claim 16, wherein step (b) comprises:

generating ultrasonic energy;

introducing the ultrasonic energy at a first end of a divider which separates the two layers having the contact interface therebetween; and, guiding the ultrasonic energy through the divider to a second end thereof opposite the first end, said second end being arranged proximate to where the two layers meet to form the contact interface as they are being extruded.

18. The method of claim 17, said method further comprising:

focusing the ultrasonic energy at the second end of the divider.

19. The method of claim 17, said method further comprising:

internally reflecting the ultrasonic energy to limit it from being transmitted laterally out of the divider.

20. The method of claim 16, wherein the plurality of layers form an upstream meniscus and a downstream meniscus as they are being extruded onto the advancing web, said method further comprising:

(d) applying ultrasonic energy to at least one of the upstream meniscus and the downstream meniscus.

21. The method of claim 20, wherein step (d) comprises:

generating ultrasonic energy;

introducing the ultrasonic energy at a first end of a side of a housing through which the plurality of layers are being extruded; and, guiding the ultrasonic energy through the side of the housing to a second end thereof opposite the first end, said second end being arranged proximate to at least one of the upstream meniscus and the downstream meniscus.

22. The method of claim 16, wherein the plurality of layers of coating material form a photoreceptor.

23. A multi-layer slot coating die comprising:

a housing having a cavity therein, said housing including first and second portions, the first portion contacting an upstream meniscus which is formed as layers of coating material are extruded from an output side of the die onto an advancing web, and the second portion contacting a downstream meniscus which is formed as layers of coating material are extruded from the output side of the die onto the advancing web;

a divider arranged within the cavity of the housing such that a plurality of separate channels are defined therein, the channels having, on the output side of the die, elongated openings from which layers of coating material are extruded; and, an ultrasonic transducer mechanically coupled to at least one of the divider, the first portion of the housing and the second portion of the housing.

* * * * *